US007267091B2

(12) United States Patent
Arnold et al.

(10) Patent No.: US 7,267,091 B2
(45) Date of Patent: Sep. 11, 2007

(54) DYNAMIC EFFORTLESS PULL STARTING

(75) Inventors: Gregory W. Arnold, Texarkana, TX (US); Yu Li, Texarkana, TX (US); Robert T. Cline, deceased, late of Texarkana, TX (US); by Cheryl Cline, legal representative, Texarkana, TX (US); Jeffery Lyle Osterchill, Texarkana, AR (US); Otto Karl Allmendinger, Texarkana, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 70 days.

(21) Appl. No.: 11/115,763

(22) Filed: Apr. 27, 2005

(65) Prior Publication Data

US 2006/0243239 A1 Nov. 2, 2006

(51) Int. Cl.
*F02N 5/02* (2006.01)

(52) U.S. Cl. ..... 123/185.14; 123/185.3

(58) Field of Classification Search ..... 123/185.2, 123/185.3, 185.4, 185.14; 185/39, 4 R, 41 R, 185/41 A, 41 C
See application file for complete search history.

(56) References Cited

U.S. PATENT DOCUMENTS 3,306,277 A 2/1967 Gudmundsen
4,651,688 A * 3/1987 Selzer et al. ..... 123/185.7
5,063,812 A * 11/1991 Mercier ..... 74/575
5,287,832 A 2/1994 Uhl
6,178,931 B1 * 1/2001 Durr ..... 123/41.65
6,263,852 B1 * 7/2001 Gracyalny et al. ..... 123/185.14
6,508,220 B1 1/2003 Akaike et al.
6,588,390 B2 7/2003 Kawasaki et al.
6,718,931 B2 4/2004 Morishige et al.
6,971,359 B2 * 12/2005 Tohyama ..... 123/185.3
7,028,658 B2 * 4/2006 Kruse et al. ..... 123/185.3
2002/0157632 A1 * 10/2002 Nemoto et al. ..... 123/185.14
2003/0094154 A1 5/2003 Morishige et al.
2004/0079313 A1 * 4/2004 Tsunoda et al. ..... 123/185.3
2005/0051127 A1 * 3/2005 Adam et al. ..... 123/185.3
2005/0252477 A1 * 11/2005 Schriever et al. ..... 123/185.14

* cited by examiner

*Primary Examiner*—Stephen K. Cronin
*Assistant Examiner*—Arnold Castro
(74) *Attorney, Agent, or Firm*—Pearne & Gordon LLP

(57) ABSTRACT

An energy storing recoil starter includes a buffering component to reduce a pull effort when starting an engine. The energy storing recoil starter includes a starter housing coupled to an engine shaft of the engine and a starter pulley. A clutch assembly is coupled between the starter housing and the starter pulley to effect rotation of an engine shaft. The buffering component is coupled between the starter housing and the engine.

34 Claims, 8 Drawing Sheets

FIG. 8
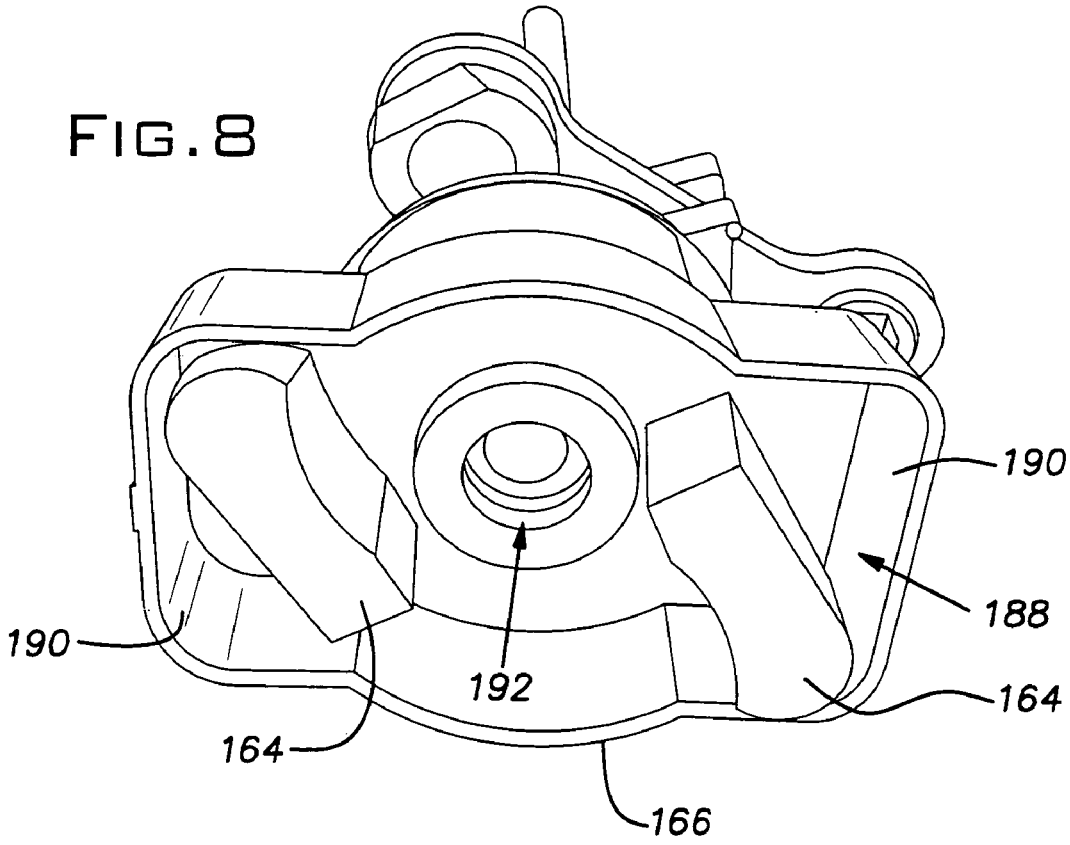
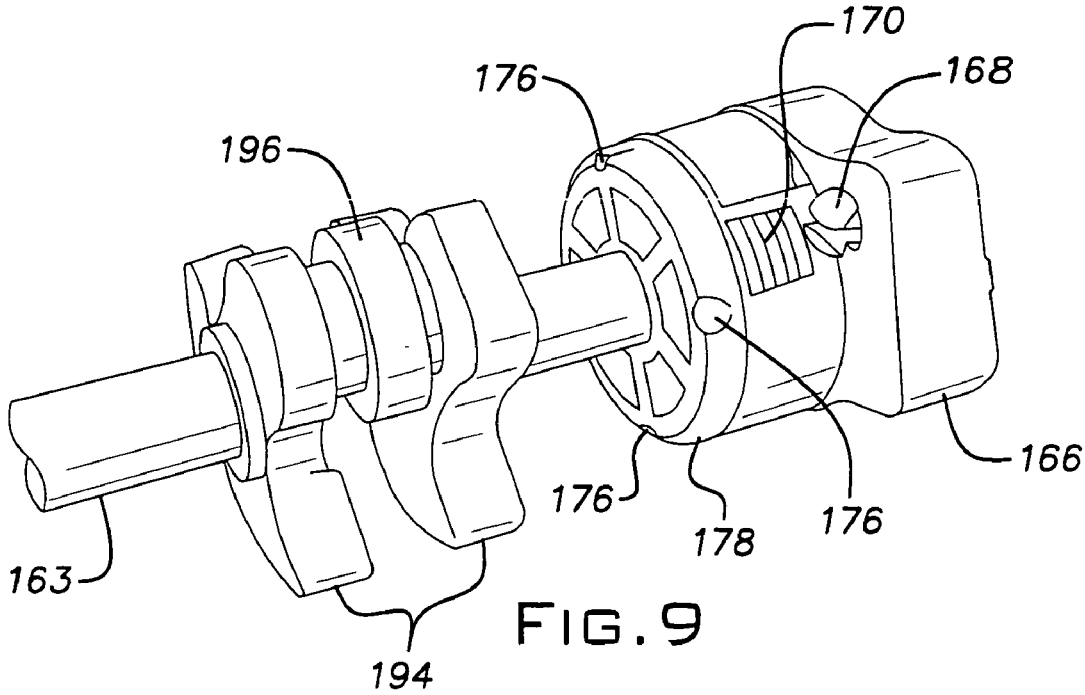
FIG. 9

FIG. 10
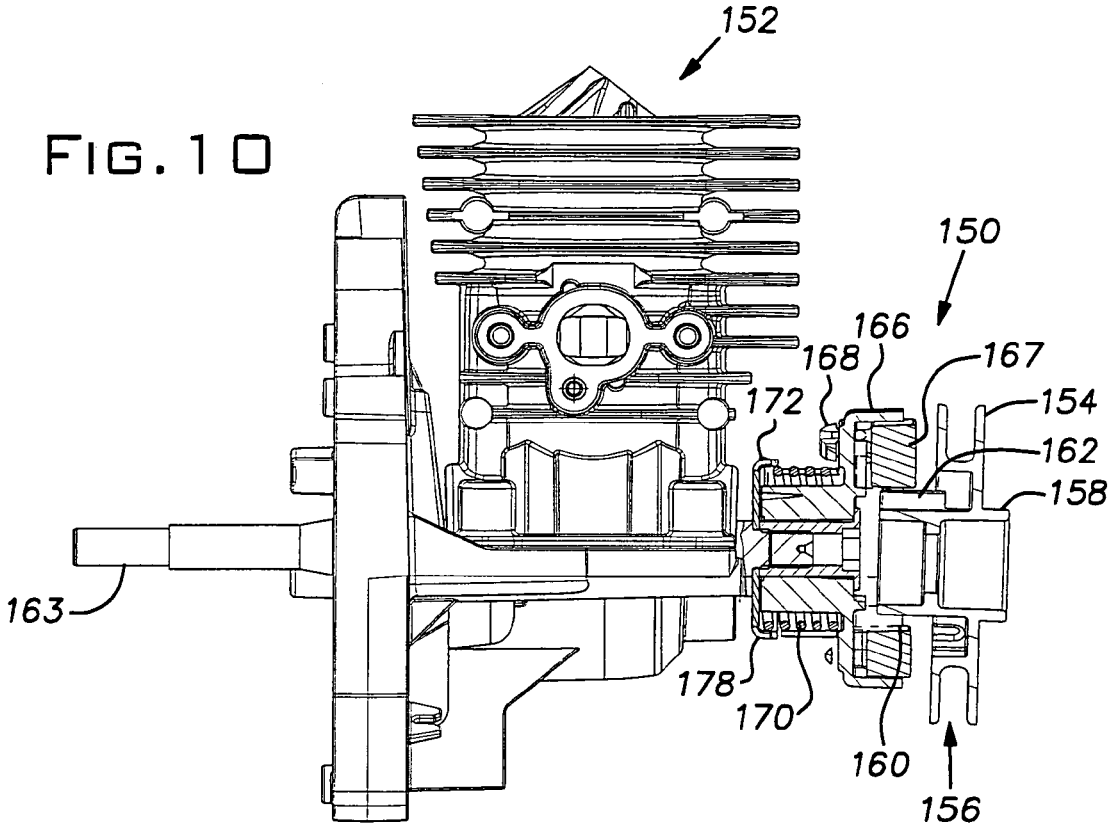
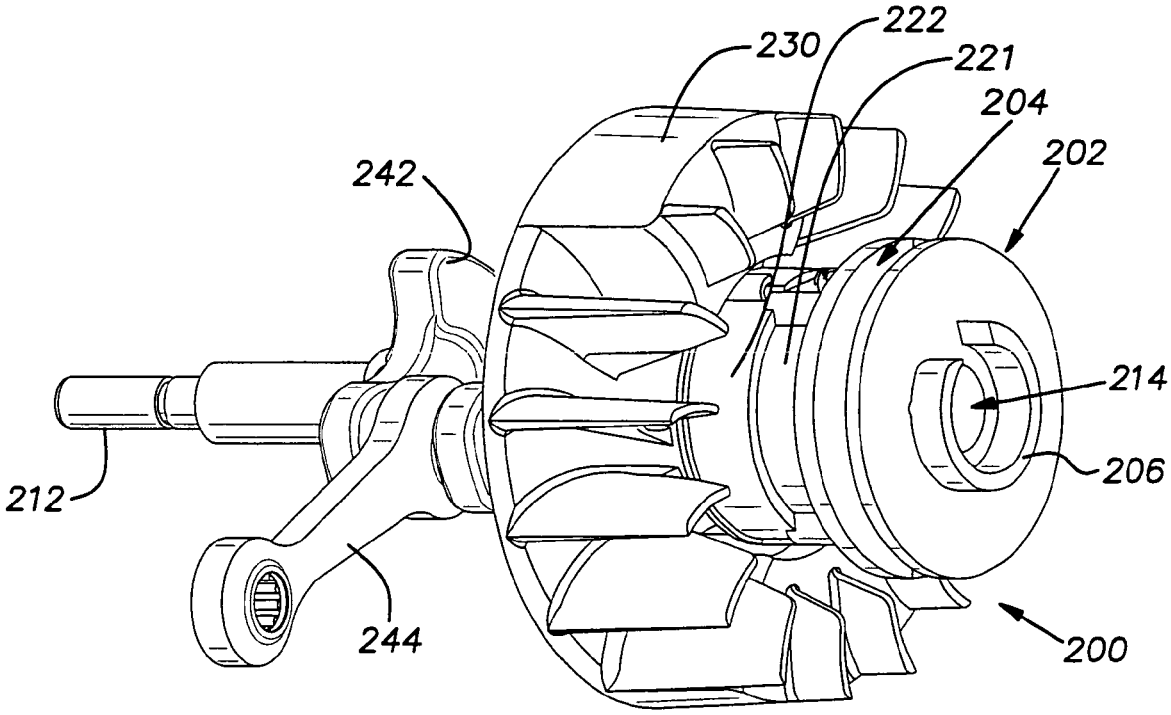
FIG. 11

FIG. 16
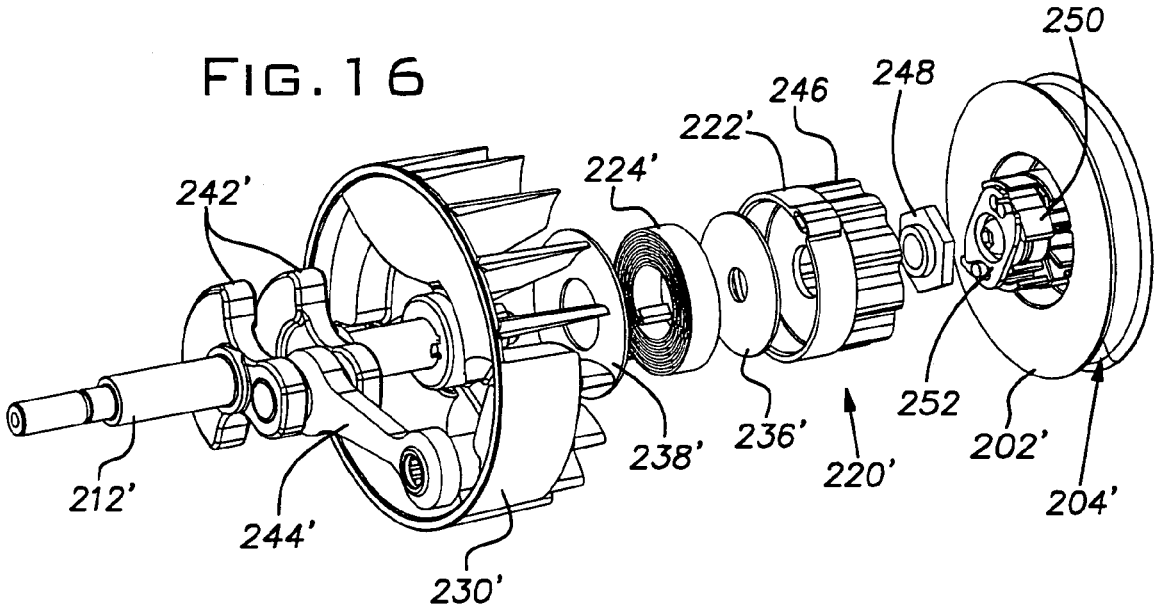
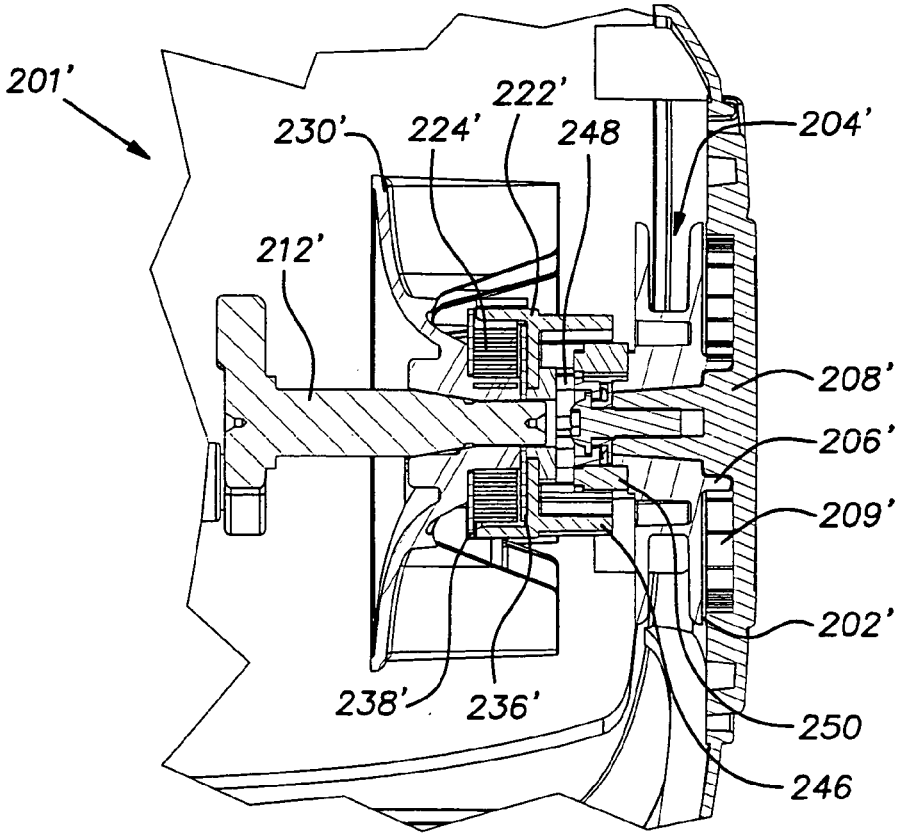
FIG. 17

DYNAMIC EFFORTLESS PULL STARTING

FIELD OF THE INVENTION

The present invention relates generally to a recoil starter for an internal combustion engine. More specifically, the present invention relates to a recoil starter for an internal combustion engine that reduces pulling forces required to start the engine.

BACKGROUND OF THE INVENTION

Conventionally, a recoil starter is used with a manually started internal combustion engine, such as a small two-stroke engine, for example. A rope pulley is rotated by pulling an attached recoil rope that is wound onto the rope pulley, thereby transmitting a rotational force to a crankshaft of the internal combustion engine by way of a ratchet and/or clutch mechanism between the pulley and a flywheel and crankshaft. Rotation of the crankshaft drives a piston and helps provide fuel for ignition. Rotation of the flywheel causes a magneto to power a spark plug, creating a spark for ignition of the engine fuel.

In operating such a starter mechanism, abrupt changes in the engine torque due to the compression of an air/fuel mixture by the piston and the cylinder within the engine typically result in an uneven and jarring pulling force during starting, and possibly even some kickback forces. These forces can make starting the engine difficult for a user.

To reduce these fluctuations in pulling force, starter mechanisms have been provided which include a second rotating member, coupled to the pulley by way of a buffering component, such as a spring, wherein this second rotating member engages with the engine crankshaft, typically using a ratchet mechanism, for transmission of the rotational force. In such a solution, rotational energy stored within the buffering spring component is used to assist in transmitting a rotational force to the engine crankshaft during periods of higher required torque, thereby dampening the pulling force required by the operator and smoothing the starting operation for the user.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, an engine and energy storing recoil starter assembly includes: an engine shaft; a starter housing operatively coupled to the engine shaft; a starter pulley; a clutch assembly coupled between the starter housing and the starter pulley, the clutch assembly being adapted to effect rotation of the engine shaft; and at least one buffering component coupled between the starter housing and the engine.

In accordance with another aspect of the present invention, an energy storing recoil starter includes: a starter pulley; a clutch assembly coupled to the starter pulley; and at least one buffering component coupled between the clutch assembly and the engine.

In according with yet another aspect of the present invention, an engine and energy storing recoil starter assembly includes: a starter housing; and at least one buffering component provided between the engine and starter housing such that the at least one buffering component resiliently connects the engine to the starter housing.

In accordance with yet another aspect of the present invention, an energy storing recoil starter comprises: a pulley having a recoil spring coupled thereto; a starter housing; at least one of a cam pawl and a clutch shell coupled between the pulley and the starter housing; at least one starter dog coupled between the pulley and the starter housing, the at least one starter dog being adapted to engage the cam pawl or clutch shell; and a buffering component coupled to the starter housing.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which:

FIG. 8 is a perspective view of starter dogs coupled to the starter housing of the recoil starter device of FIG. 6 in accordance with an aspect of the present invention;

FIG. 9 is a perspective view of the starter housing, torsion spring, and end cap of the recoil starter device of FIG. 6 assembled with an engine shaft in accordance with an aspect of the present invention;

FIG. 10 is a cross sectional view of the recoil starter device of FIG. 6 in accordance with an aspect of the present invention;

FIG. 11 is a perspective view of another recoil starter device in accordance with an aspect of the present invention;

FIG. 16 is another exploded view of the recoil starter device of FIG. 14 in accordance with an aspect of the present invention; and FIG. 17 is a cross sectional view of the recoil starter device of FIG. 14 in accordance with an aspect of the present invention.

DESCRIPTION OF EXAMPLE EMBODIMENTS

Figure 1:
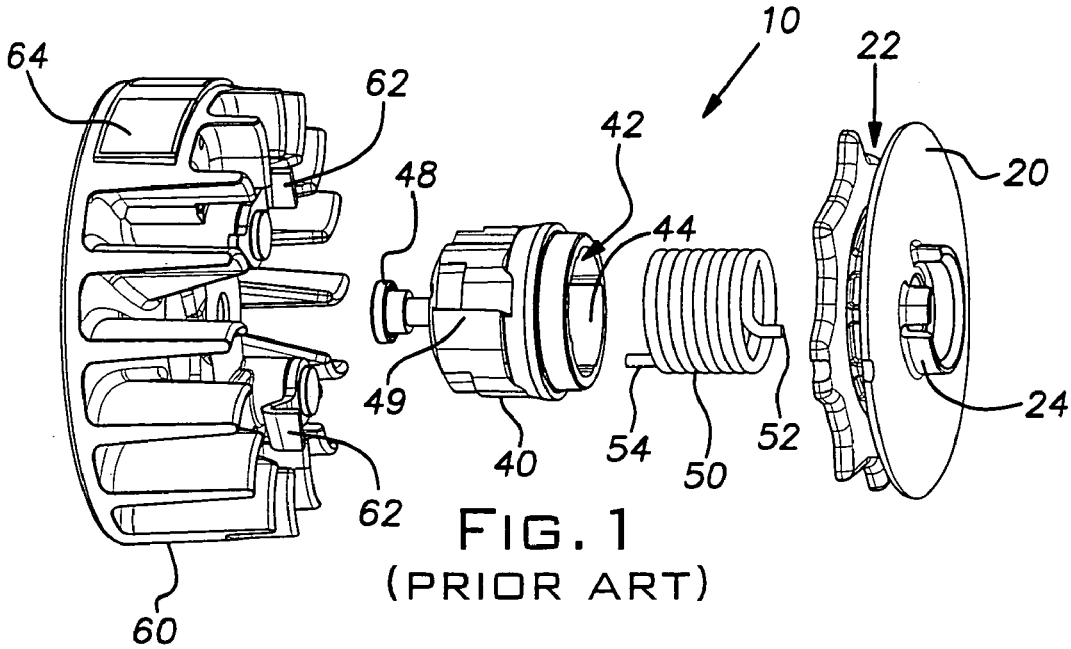
FIG. 1 (PRIOR ART)
FIG. 1 is an exploded view of a portion of a prior art recoil starter device.

The present invention relates to a recoil starter device that generally provides an improved pulling performance and may provide a reduced pull effort or pull feel. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

Figure 2:
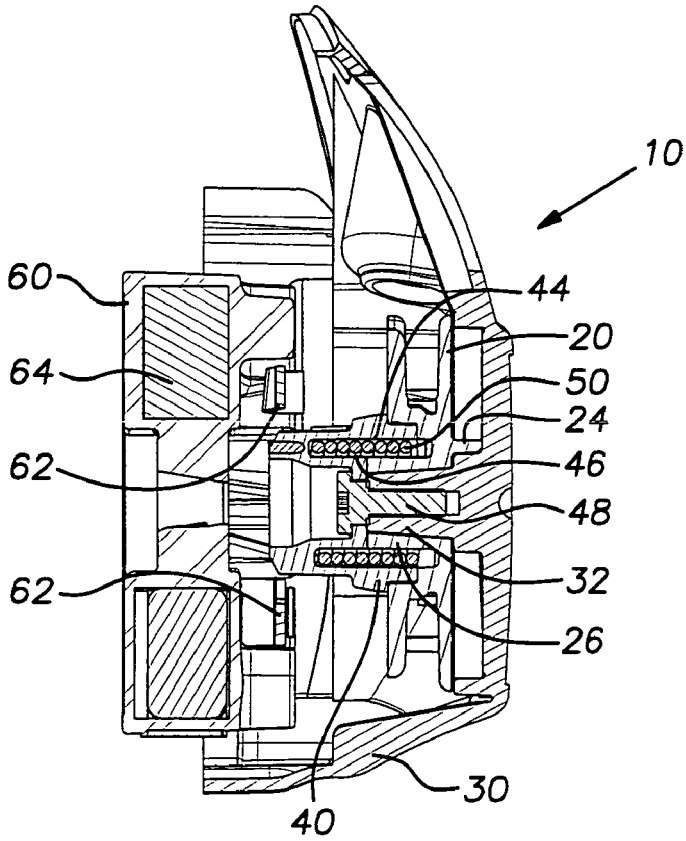
FIG. 2 (PRIOR ART)
FIG. 2 is a cross sectional view of the prior art recoil starter device of FIG. 1.

FIGS. 1 and 2 illustrate a prior art recoil starter device 10. The recoil starter device 10 includes a pulley 20 having a collar portion 22 around which a recoil rope (not shown) is wound. The pulley 20 further includes a projection 24 at a first end of the pulley 20 to facilitate alignment of the pulley 20 with a housing 30; and a hollow cylindrical post 26 projecting from a second end of the pulley 20 to facilitate axial alignment of the pulley 20 with a hub 40. The pulley 20 and the hub 40 are resiliently coupled together via a torsion spring 50, such that the torsion spring 50 acts as an energy storage component to buffer the hub 40 from the pulley 20. More specifically, the torsion spring 50 includes first and second ends 52 and 54, which are bent in a substantially axial direction. The first end 52 is received by a first aperture (not shown) located in the pulley 20 and a portion of the torsion spring 50 is disposed about the hollow cylindrical post 26. Likewise, the second end 54 of the torsion spring 50 is received by a second aperture (not shown) located in the hub 40 and the torsion spring 50 is substantially encompassed within an annular cage 42 of the hub 40. The annular cage includes a cylindrical outer wall 44 and a cylindrical inner wall 46, or post, within which the torsion spring 50 is disposed. A bolt 48, or any other suitable fastener, is utilized to rotatably couple the recoil starter 10 and the housing 30 together.

The recoil starter 10 is operably coupled to a flywheel 60, which has one or more starter dogs 62 mounted thereon. The hub 40 of the recoil starter 10 includes one or more cam pawls 49 which are operable to engage the starter dogs 62. Thus, when the recoil starter 10 is rotated via the recoil rope, the cam pawls 49 engage the starter dogs 62, thereby rotating the flywheel 60. Inside the flywheel 60 are a plurality of magnets 64, which are operable to generate a magnetic field upon rotation of the flywheel 60. When the magnets 64 spin around electric coils (not shown) of a magneto (not shown), an electric current is generated, which thereby passes to a spark plug (not shown) and rotatably drives a crankshaft (not shown).

Typically, when the torsion spring 50 is twisted in a contracting direction, a diameter of the torsion spring 50 is reduced; and when the torsion spring 50 is twisted in an expanding direction, the diameter of the torsion spring 50 is increased. Thus, in the above-described conventional recoil starter 10, the cylindrical post 26 of the pulley 20 and the annular cage inner wall 46 of the hub 40 serve to limit a minimum diameter of the torsion spring 50 when the torsion spring 50 is twisted in a contracting direction. Likewise, the annular cage outer wall 44 of the hub 40 serves to limit a maximum diameter of the torsion spring 50 when the torsion spring 50 is twisted in an expanding direction. The configuration of the cylindrical post 26 of the pulley 20 and annular cage 42 of the hub 40 further serves to limit an initial, or relaxed, size of torsion spring that can be employed with the assembly.

Figure 3:
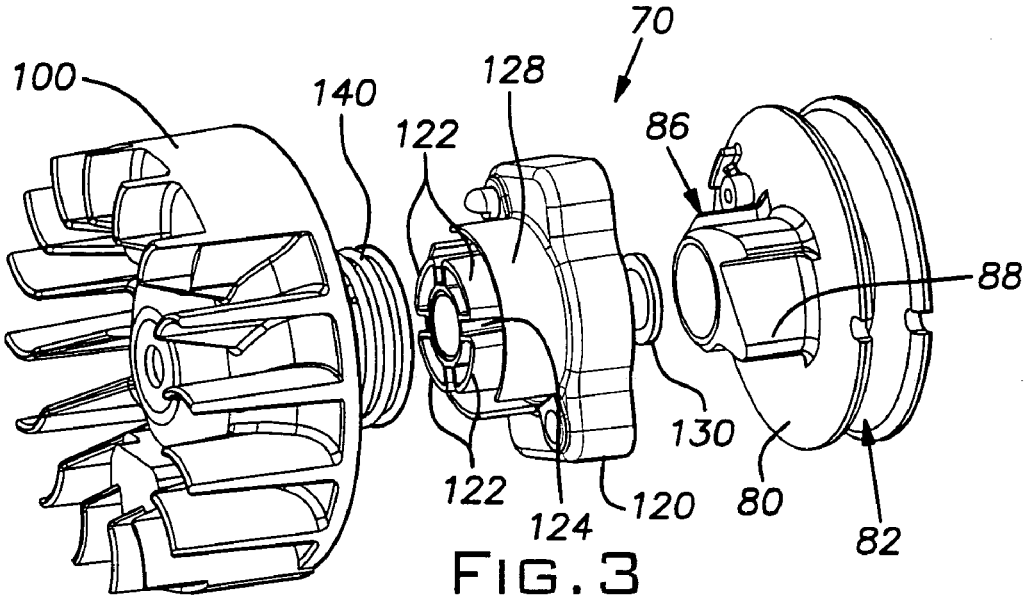
FIG. 3 is an exploded view of a recoil starter device in accordance with an aspect of the present invention.
Figure 4:
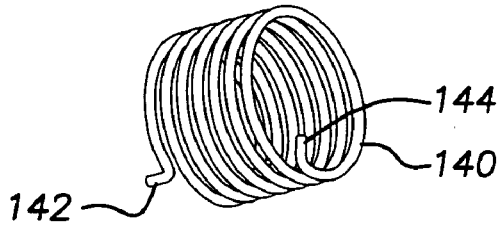
FIG. 4 is a perspective view of a torsion spring employed in the recoil starter device of FIG. 3 in accordance with an aspect of the present invention.
Figure 5:
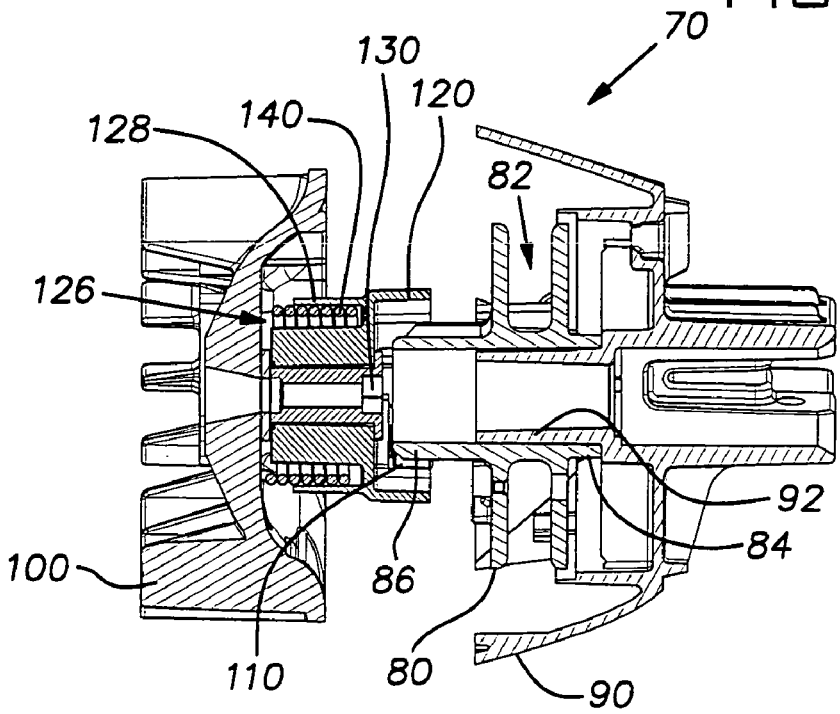
FIG. 5 is a cross sectional view of the recoil starter device of FIG. 3 in accordance with an aspect of the present invention.

Turning now to FIGS. 3-5, a recoil starter device 70 is illustrated in accordance with an aspect of the present invention. The recoil starter device 70 is employed to aid a manually started engine, such as a two-stroke engine, for example, which is typically adapted to be disposed in a gas-powered tool, such as a chain saw. The recoil starter device 70 includes a starter pulley 80 having a collar portion 82 for receiving a recoil rope (not shown). A first end of the pulley 80 includes a projection 84 to facilitate alignment of the pulley 80 with a housing 90, which can be of cast metal construction, or the like. A second end of the pulley 80 is operatively coupled to a starter housing 120 via a clutch assembly. For instance, the second end of the pulley 80 can include a boss portion 86, which has at least one cam pawl 88 projecting from an outer peripheral surface of the boss portion 86. The cam pawl(s) 88 has an engaging surface facing in an engine starting rotation direction and is arranged along a circumferential direction, so as to transmit rotation of the cam to a flywheel 100, which will be discussed in further detail below. The pulley 80 further includes a bore through a central portion thereof for receiving a boss 92 of the housing 90.

The cam pawl(s) 88 is adapted to engage with one or more starter dogs 110, which are secured to the starter housing 120 to effect rotation of an engine shaft (not shown). The starter housing 120 is coupled to the engine shaft via a fastener 130, or the like. At least one buffering component 140 is provided between the flywheel 100 and the starter housing 120 to resiliently connect the two components 100 and 120. For example, in the present embodiment, the buffering component(s) includes a torsion spring 140. However, it is to be appreciated that any other suitable buffering component(s) can be employed. The buffering component 140 operates to buffer or dampen vibrations resulting from normal engine vibration between the engine and the recoil starter. Further, all of the force for pulling the recoil rope is not directly related to the starting of the engine. Instead the pulling force of the rope is combined with the buffering component 140 to produce a resultant force to start the engine. Thus, even if the force for pulling the recoil rope is weak, the engine can be easily and reliably started.

Similar to the prior art device, when the recoil starter 70 is rotated via the recoil rope, the cam pawl(s) 88 engage the starter dogs 110, thereby rotating the starter housing 120 and flywheel 100. Inside the flywheel 100 are a plurality of magnets (not shown), which are operable to generate a magnetic field upon rotation of the flywheel 100. When the magnets spin around electric coils (not shown) of a magneto (not shown), an electric current is generated, which thereby passes to a spark plug (not shown) and rotatably drives a crankshaft (not shown).

The torsion spring 140 is more clearly illustrated in FIG. 4 and includes a first end 142 and a second end 144. The first end 142 is bent in a substantially axial direction such that it can be fitted within an aperture (not shown) provided in the flywheel 100. The second end 144 is bent in a substantially radial direction such that it can be engaged within a recess located between two of a plurality of ribs 122 extending from a cylindrical post 124 (FIG. 3) of the starter housing 120. However, it is to be appreciated that the torsion spring 140 can have any suitable configuration and can be coupled between the flywheel 100 and the starter housing 120 in any suitable manner and is contemplated as falling within the scope of the present invention. For instance, a torsion spring can be employed having both ends bent in an axial direction, with one end being received within an aperture in the flywheel and the other end being received within an aperture in the starter housing.

Turning back to FIG. 3, the axially extending ribs 122 projecting from the cylindrical post 124 of the starter housing 120 are substantially evenly spaced about a periphery of the cylindrical post 124. It is to be appreciated that while only four axially extending ribs are illustrated with respect to FIG. 3, any number and configuration of axially extending ribs can be employed. As another example, the cylindrical post 124 may include one or more depressions, channels, apertures, or the like, for receiving the second end 144 of the torsion spring 140. Such a configuration of ribs (or depressions, channels, apertures, etc.) Facilitates easier assembly of the flywheel 100, torsion spring 140, and starter housing 120. For instance, when assembling, a user can easily see the first end 142 of the torsion spring 140 when inserting the first end 142 within the flywheel aperture. However, when coupling the starter housing 120 with the torsion spring 140, the second end 144 is blindly coupled to the starter housing 120. Accordingly, with the plurality of options for receiving the second end 144 of the torsion spring 140, the user does not have to be concerned with orientation of the second end 144 of the spring 140 with respect to the starter housing 120 in order to effectively couple the two components together.

As can be seen with respect to FIG. 5, the recoil starter 70 in accordance with an aspect of the present invention substantially decreases the size constraints imposed on the one or more buffering components as compared to the prior art recoil starter (e.g. Recoil starter 10). For example, turning briefly to FIG. 2, the torsion spring 50 in the prior art recoil starter 10 was constrained by the outer diameter of the cylindrical post 26 and the outer and inner diameters 44, 46 of the annular cage 42 of the hub 40. In contrast, turning back to FIG. 5, the torsion spring 140 in accordance with an aspect of the present invention is merely constrained by an area 126 formed between the axially extending ribs 122 or the cylindrical post 124 of the starter housing 120 and a retaining structure, which can be a substantially annular projection, 128 of the starter housing 120. This area 126 is substantially larger than the area provided by the annular cage 42 of the hub 40 in the prior art device.

In accordance with an aspect of the present invention, the substantially annular projection 128 is concentrically located about the cylindrical post 124. However, it is to be appreciated that any other suitable retaining structure can be integral with or otherwise coupled to the starter housing 120 or flywheel 100 and employed to retain the torsion spring 140 in position. Accordingly, an outer diameter of the torsion spring 140 cannot exceed the retaining structure 128 and an inner diameter of the torsion spring 140 cannot be less than an outer diameter of the cylindrical post 124 or the axially extending ribs 122 of the starter housing 90. The area 126 formed between the retaining structure 128 and the cylindrical post 124 or axially extending ribs 122 is substantially greater than the hub cage 42 of the prior art. Thus, the size of the torsion spring 140 can be optimized for maximum spring life, or in other words, a number of times the starter assembly can be actuated prior to wear of the torsion spring 140, or other suitable buffering component, is significantly increased.

Figure 6:
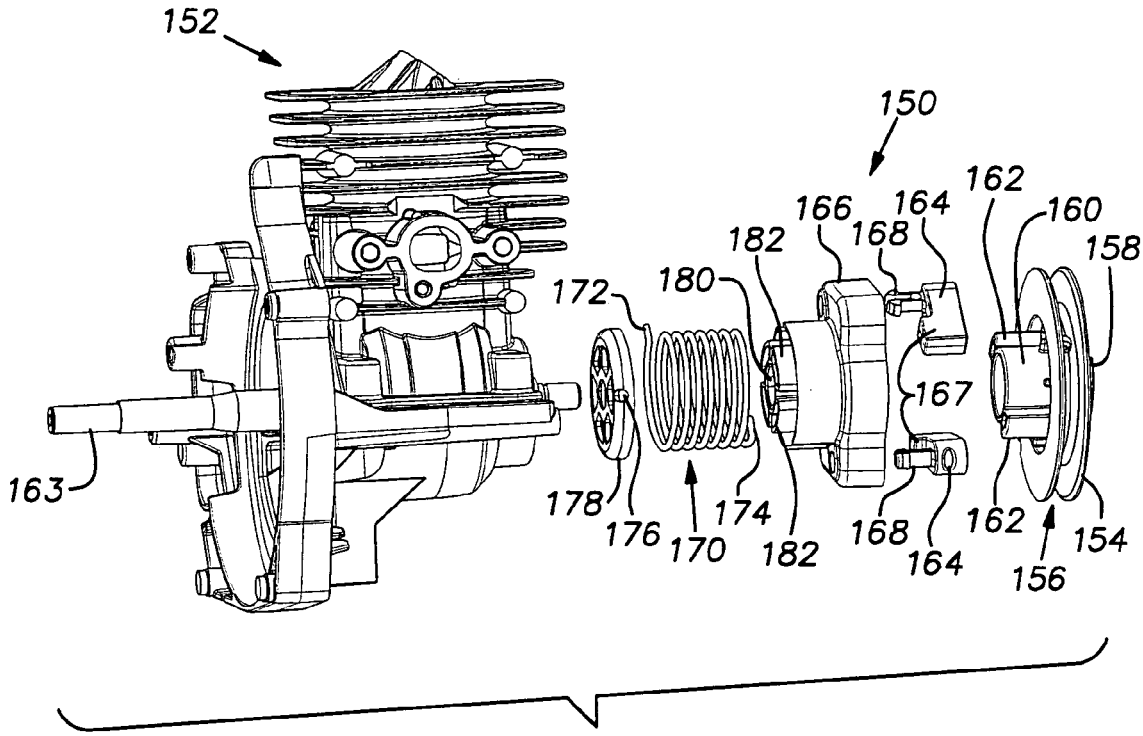
FIG. 6 is an exploded view of a recoil starter device in accordance with another aspect of the present invention.

Turning now to FIGS. 6-10, another example of a recoil starter device 150 is illustrated in accordance with an aspect of the present invention. The recoil starter device 150 is employed to aid a manually started engine 152, such as a two-stroke engine, for example. The recoil starter device 150 includes a starter pulley 154 having a collar portion 156 for receiving a recoil rope (not shown). The pulley 154 includes a projection 158 to facilitate alignment of the pulley 154 with a housing (not shown), which can be of cast metal construction, or the like. The pulley 154 is also operatively coupled with a starter housing 166 via a clutch assembly, as will be described in greater detail herein. The clutch assembly includes a boss portion 160, which projects from the starter pulley 154 and has at least one cam pawl 162 that project from an outer peripheral surface of the boss portion 160. FIG. 6 depicts the pulley 154 as having two cam pawls 162, which radially extend from opposing sides of the boss portion 160. However, it is to be appreciated that any number of cam pawls having any suitable configuration can be utilized. The cam pawls 162 have an engaging surface facing in an engine starting rotation direction and are arranged along a circumferential direction, so as to transmit rotation of the cam to an engine shaft 163, which will be discussed in further detail below. The pulley 154 further includes a bore through a central portion thereof for receiving a boss (not shown) of the housing.

The clutch assembly further includes at least one starter dog 164, which are adapted to operatively engage the cam pawls 162. FIG. 6 depicts utilizing two starter dogs 164; however, it is to be appreciated that any number of starter dogs can be employed. The starter dogs 164 can be manufactured from a rigid polymer material and each starter dog 164 includes a main body portion 167 for engaging the at least one cam pawl 162 and a connector portion 168 for engaging the starter housing 166. Specifically, the connector portion 168 of each starter dog 164 can be received through an aperture provided in the starter housing 166. Each connector portion 168 can provide a snap fit engagement with the housing 166 and is operable to rotate within the aperture. It is to be appreciated that the starter dogs 164 can be coupled to the starter housing 166 in any suitable manner.

A second side of the starter housing 166 is coupled to at least one buffering component 170. Thus, the buffering component 170 is provided in an area located between the engine 152 and the clutch assembly. For example, in the present embodiment, the buffering component(s) includes a torsion spring 170. However, it is to be appreciated that any other suitable buffering component(s) can be employed and is contemplated as falling within the scope of the present invention. As in the example embodiment described above, the buffering component operates to buffer or dampen vibrations resulting from normal engine vibration between the engine and the recoil starter and to reduce the force needed to pull the recoil rope and start the engine.

Figure 7:
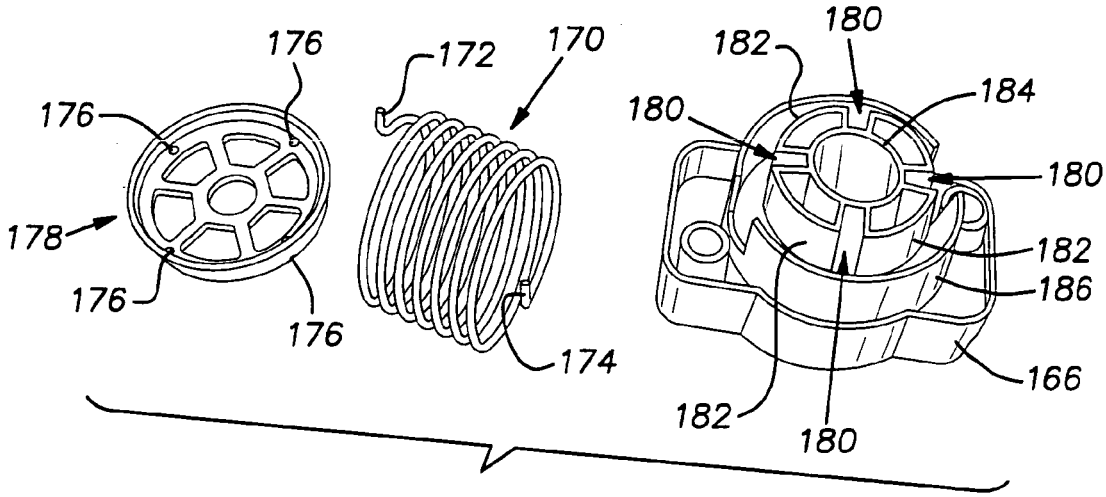
FIG. 7 is a perspective view of a starter housing, torsion spring, and end cap of the recoil starter device of FIG. 6 in accordance with an aspect of the present invention.

As can be seen more clearly in FIG. 7, the torsion spring 170 includes a first end 172 and a second end 174. The first end 172 is bent in a radially outward direction such that it can be fitted within an aperture 176 provided in the end cap 178. The end cap 178 can include a plurality of apertures 176 to facilitate easier alignment of the torsion spring 170 with the end cap 178. For instance, four apertures 176 can be substantially evenly spaced about a periphery of the end cap 178. The second end 174 of the torsion spring 170 is bent in a radially inward direction such that it can be engaged within a recess 180 located between two of a plurality of ribs 182 radially extending from a cylindrical post 184. The cylindrical post 184 extends from the second side of the housing 166. The plurality of ribs 182 can be substantially evenly spaced about a periphery of the cylindrical post 184. It is to be appreciated that while only four axially extending ribs 184 are illustrated, any number and configuration of axially extending ribs 184 can be employed. Alternatively or additionally, the cylindrical post may include one or more depressions, channels, apertures, or the like, for receiving the second end 174 of the torsion spring 170. Such a configuration of ribs (or depressions, channels, apertures, etc.) Facilitates easier assembly of the end cap 178, torsion spring 170, and housing 166. For instance, during assembly of the recoil starter device 150, a user can easily see the first end 172 of the torsion spring 170 when inserting the first end 172 within one of the end cap apertures 176. However, when coupling the torsion spring 170 with the housing 166, the second end 174 of the torsion spring 170 is typically blindly coupled to the housing 166. Accordingly, with the plurality of options for receiving the second end 174 of the torsion spring 170, the user does not have to be concerned with orientation of the second end 174 of the spring 170 with respect to the housing 166 in order to effectively couple the components together.

However, it is to be appreciated that the torsion spring 170 can have any suitable configuration and can be coupled between the end cap 174 and the second side of the housing 166 in any suitable manner and is contemplated as falling within the scope of the present invention. For instance, a torsion spring can be employed having both ends bent in an axial direction, with one end being received within an aperture in the end cap and the other end being received within an aperture in the housing.

The second side of the housing 166 further includes a retaining structure 186, which is concentrically located about the cylindrical post 184. Accordingly, an outer diameter of the torsion spring 170 cannot exceed the retaining structure 186 and an inner diameter of the torsion spring 170 cannot be smaller than an outer diameter of the cylindrical post 184 or the axially extending ribs 182. The area formed between the retaining structure 186 and the cylindrical post 184 or axially extending ribs 182 is substantially greater than the hub cage 42 of the prior art (see FIG. 10). Thus, the size of the torsion spring 170 can be optimized for maximum spring life, or in other words, a number of times the starter assembly can be actuated prior to wear of the torsion spring 170, or other suitable buffering component, is significantly increased. It is to be appreciated that any other suitable retaining structure can be integral with or otherwise coupled to the housing 166, or alternatively, to the end cap 178, and employed to retain the torsion spring 170 in position.

Turning now to FIG. 8, the first side of the housing 166 having the starter dogs 164 coupled thereto is illustrated in greater detail. The first side of the housing 166 includes a recessed area 188 in which the starter dogs 164 are positioned. The starter dogs 164 are rotatable about their connector portions 168 and the extent to which the starter dogs 164 can rotate is defined by sidewalls 190 of the recessed area 188. The housing 166 also includes a central bore 192 provided therethrough for coupling of the engine shaft to 163 the recoil starter device 150.

FIG. 9 depicts a portion of the recoil starter device 150 as assembled. The starter dogs 164 are coupled to the first side of the housing 166 via the connector portions 168; and the torsion spring 170 is coupled to the second side of the housing 166 via the radially inward extending end 174. One of the apertures 176 in the end cap 178 is coupled to the radially outward extending end 172 of the torsion spring 170. The engine shaft 163 is provided through corresponding bores in the end cap 178, torsion spring 170, and housing 166 and is secured to the assembly via a suitable fastener (not shown) provided through the central bore 192 in the first side of the housing 166. The engine shaft 163 is coupled to one or more counterweights 194 and a crank pin 196, as is conventional.

During operation of the recoil starter device 150, the recoil starter 150 is rotated via the recoil rope. The cam pawl(s) 162 are thus rotated and engage the starter dogs 164, which in turn operate to rotate the housing 166 and engine shaft 163. The presence of the torsion spring 170 operates to buffer or dampen vibrations resulting from normal engine vibration between the engine and the recoil starter 150 and to reduce the force needed to pull the recoil rope and start the engine 152.

Figure 12:
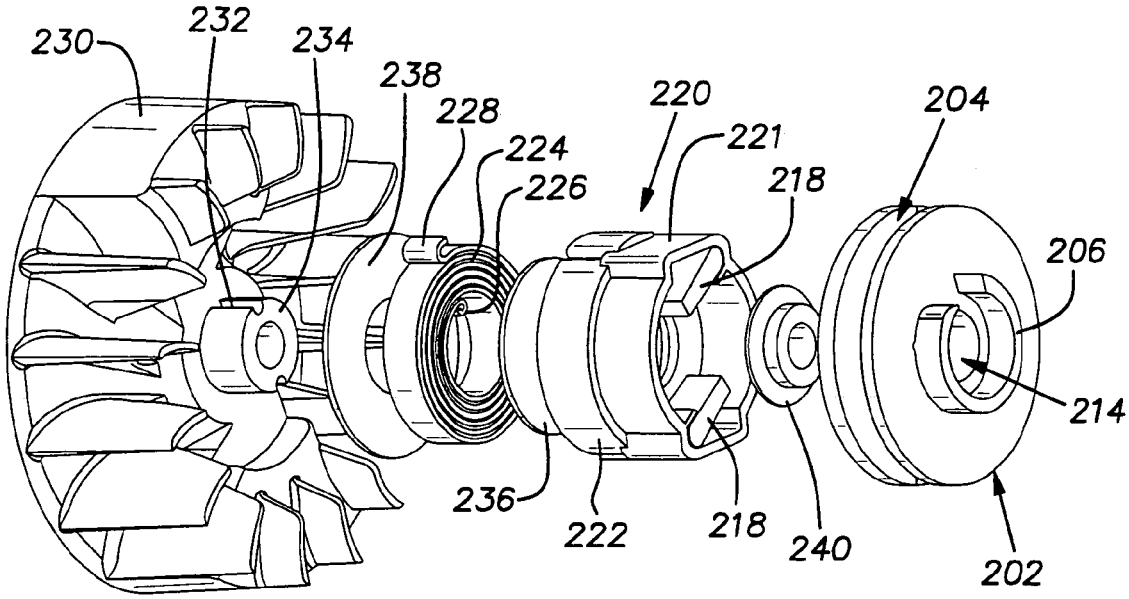
FIG. 12 is an exploded view of the recoil starter device of FIG. 11 in accordance with an aspect of the present invention.
Figure 13:
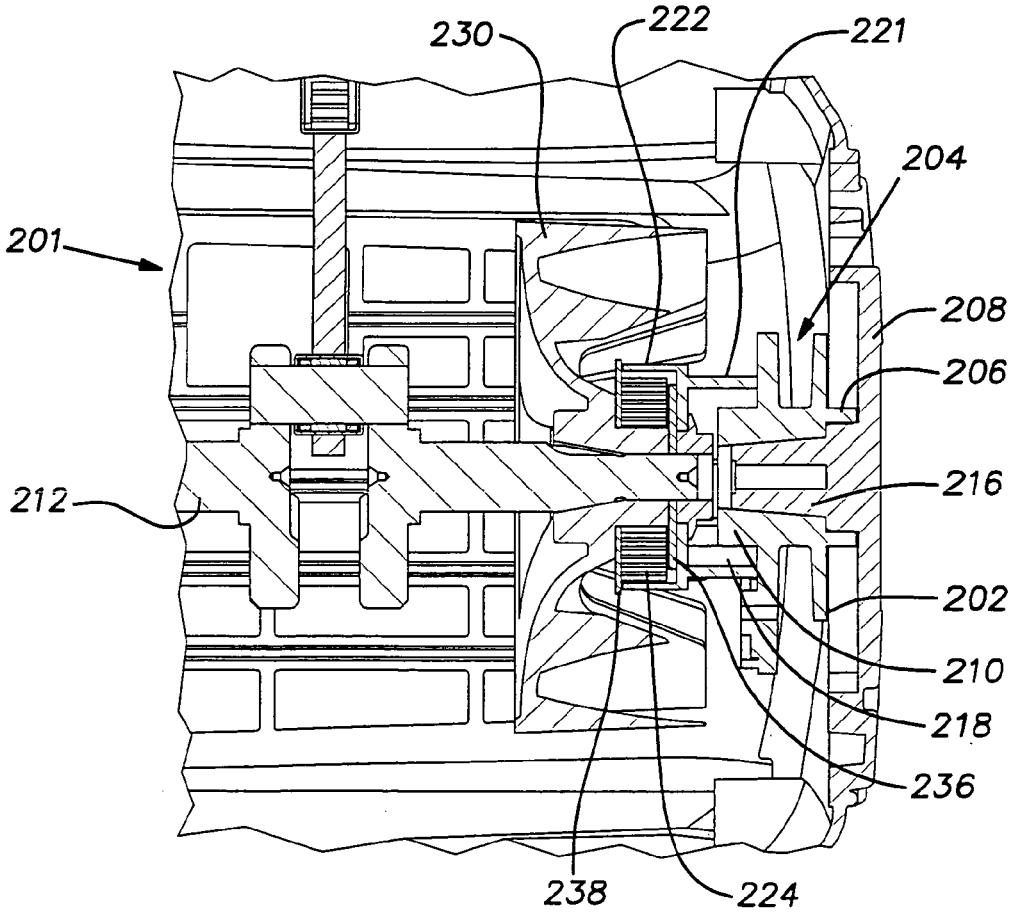
FIG. 13 is a cross sectional view of the recoil starter device of FIG. 11 in accordance with an aspect of the present invention.
Figure 14:
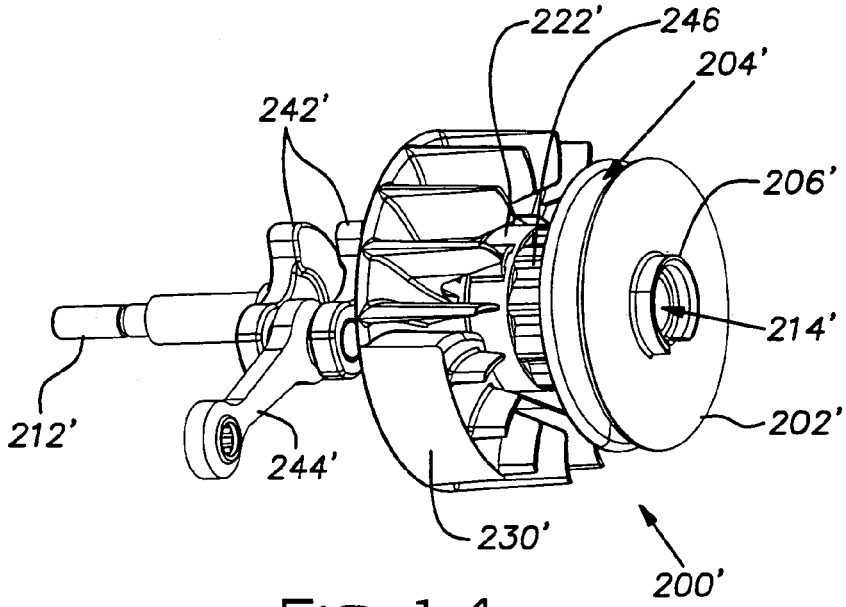
FIG. 14 is a perspective view of another recoil starter device in accordance with an aspect of the present invention.
Figure 15:
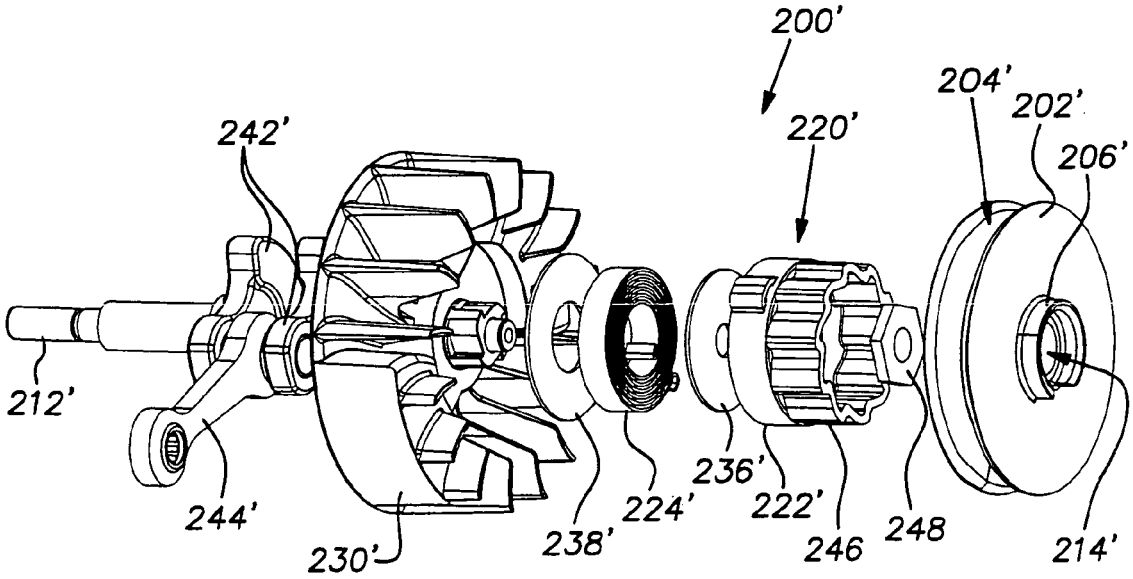
FIG. 15 is an exploded view of the recoil starter device of FIG. 14 in accordance with an aspect of the present invention.

Turning now to FIGS. 11-13, another example of a recoil starter device 200 for an engine 201, such as a two-stroke engine, is depicted. As in the previous examples discussed herein, the recoil starter device 200 includes a starter pulley 202 having a collar portion 204 for receiving a recoil rope (not shown). A first end of the pulley 202 includes a projection 206 to facilitate alignment of the pulley 202 with an engine housing 208, which can be of cast metal construction, or the like. A recoil spring 209 is provided around and coupled to the projection 206. A second end of the pulley is operatively connected to a starter housing 220 via a clutch assembly. Although, not illustrated in detail, the second end of the pulley 202 includes a boss portion 210, which has at least one cam pawl (not shown) projecting from an outer peripheral surface of the boss portion 210. The cam pawl(s) can be of any suitable configuration, such as those described and illustrated with respect to FIGS. 3 and 6. The cam pawl(s) has an engaging surface facing in an engine starting rotation direction and is arranged along a circumferential direction, so as to transmit rotation of the cam to an engine shaft 212, which will be discussed in further detail below. The pulley 202 further includes a bore 214 through a central portion thereof for receiving a boss 216 of the engine housing 208.

The cam pawl(s) of the pulley 202 is adapted to operatively engage at least one starter dog 218 coupled to a first side of a starter housing 220. FIG. 12 depicts utilizing two starter dogs 218; however, it is to be appreciated that any number of starter dogs can be employed. The starter dogs 218 can be manufactured from a rigid polymer material and can be coupled within a first boss portion 221 provided on the first side of the starter housing 220 in a manner similar to that illustrated and discussed above with respect to FIGS. 6-10. It is to be appreciated that the starter dogs 218 can be coupled to the starter housing 220 in any suitable manner.

A second side of the starter housing 220 includes a second boss portion 222, which is adapted to receive at least one buffering component 224 within a central portion thereof. Thus, the buffering component 224 is provided in an area located between the engine and the starter pulley 202, which includes the cam pawl(s) thereon. For example, in the present embodiment, the buffering component(s) includes a flat spring 224. However, it is to be appreciated that any other suitable buffering component(s) can be employed and is contemplated as failing within the scope of the present invention. As in the example embodiment described above, the buffering component operates to buffer or dampen vibrations resulting from normal engine vibration between the engine and the recoil starter and to reduce the force needed to pull the recoil rope and start the engine.

As can be seen more clearly in FIG. 12, the flat spring 224 includes a first end 226 and a second end 228. The first and second ends 226, 228 of the flat spring 224 are substantially U-shaped and are adapted to engage the ends of the flat spring 224 with the starter housing 220 and a flywheel 230 respectively. The first U-shaped end 226 engages a slot (not shown) in an inner portion of the second boss 222. The second U-shaped end 228 of the flat spring 224 engages a slot 232 provided in a hub portion 234 of the flywheel 230. FIG. 12 illustrates two slots 232 at opposing sides of the hub portion 234 to facilitate easier alignment of the spring 224 with the flywheel 230; however, it is to be appreciated that any suitable number of slots, including one, can be provided in a portion of the flywheel 230. During assembly of the recoil starter device 200, a user can easily see the first end 226 of the spring 224 when coupling the spring 224 with the starter housing 220. However, when coupling the spring 224 with the flywheel 230, the second end 228 of the flat spring 224 is typically blindly coupled to the flywheel 230. Accordingly, having more than one slot for receiving the second end 228 of the flat spring 224 facilitates easier coupling of the spring 224 and flywheel 230. However, it is to be appreciated that the flat spring 224 can have any suitable configuration and can be coupled between the starter housing 220 and the flywheel 230 in any suitable manner and is contemplated as falling within the scope of the present invention.

The starter device 200 also includes first and second flat washers 236 and 238 provided on each side of the flat spring 224 to provide additional stability of the flat spring 224 within the recoil starter device 200.

In assembling the recoil starter device 200, the engine shaft 212 is provided through a central portion of the flywheel 230, the second flat washer 238, the flat spring 224, the first flat washer 236, and the starter housing 220 and is secured to a fastener 240 at the first side of the starter housing 220. The engine shaft 212 includes one or more counterweights 242 and a crankshaft 244, as is conventional. The recoil starter device 200 operates in a manner similar to the recoil starter devices 70 and 150, discussed above.

Turning now to FIGS. 14-17, another example of a recoil starter device 200' is illustrated in accordance with an aspect of the present invention. Same or similar parts of the present example are designated by the same reference characters employed above in connection with FIGS. 11-13 but distinguished therefrom by the addition of a prime. In all major respects these two recoil starters 200, 200' are constructed in the same general manner and operate similarly with the exception that clutch assembly components are constructed and mounted differently, as will be described in further detail below. The recoil starter device 200' includes a starter pulley 202' having a collar portion 204' or receiving a recoil rope (not shown). A first end of the pulley 202' includes a projection 206' to facilitate alignment of the pulley 202 with an engine housing 208', which can be of cast metal construction, or the like. A recoil spring 209' is provided around and coupled to the projection 206.

As can be seen more clearly in FIG. 16, at least one starter dog 250 is coupled to the starter pulley 202' via a suitable connector element 252. Two starter dogs 250 are depicted in FIG. 16; however any number of starter dogs, including one, can be employed. The starter dogs 250 are adapted to engage a clutch element, such as a clutch shell 246. The clutch shell 246 is configured as a single piece with the starter housing 220', which can be coupled to an engine shaft 212' via a suitable fastener 248. An inner wall of the clutch shell 246 includes a plurality of teeth with which the clutch shell 246 engages with the starter dogs 250. When rotation is imparted to the starter pulley 202' by pulling on the rope, the starter dogs 250 pivot outwardly. In this outwardly pivoted position, the starter dogs 250 engage respective tooth gullets of the clutch shell teeth. Thus, rotation is imparted to the clutch shell 246 and therefore also to the engine shaft 212' to be driven.

A second side of the starter housing 220' includes a boss portion 222', which is adapted to receive at least one buffering component 224' within a central portion thereof. Thus, the buffering component 224' is provided in an area located between the engine and the clutch elements. For example, in the present embodiment, the buffering component(s) includes a flat spring 224'. However, it is to be appreciated that any other suitable buffering component(s), such as a torsion coil spring, can be employed and is contemplated as falling within the scope of the present invention. As in the example embodiment described above, the buffering component operates to buffer or dampen vibrations resulting from normal engine vibration between the engine and the recoil starter and to reduce the force needed to pull the recoil rope and start the engine.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. An engine and energy storing recoil starter assembly comprising:

an engine shaft;

a starter housing operatively coupled to the engine shaft and at least one rotatable starter dog coupled to the starter housing;

a starter pulley including at least one cam pawl extending therefrom; and at least one buffering component coupled between the starter housing and the engine;

wherein the at least one cam pawl of the starter pulley is adapted to engage the at least one starter dog of the starter housing as the starter pulley begins to rotate; and wherein the at least one starter dog of the starter housing becomes disengaged from the at least one cam pawl of the starter pulley via centrifugal force.

2. The engine and energy storing recoil starter assembly of claim 1, wherein the at least one buffering component is a torsion spring.

3. The engine and energy storing recoil starter assembly of claim 1, wherein the at least one buffering component is a flat spring.

4. The engine and energy storing recoil starter assembly of claim 1, wherein the at least one buffering component is a spring having a first end and a second end, the first end of the spring being coupled to the starter housing.

5. The engine and energy storing recoil starter assembly of claim 4, wherein the second end of the spring is coupled to a flywheel.

6. The engine and energy storing recoil starter assembly of claim 4, wherein the second end of the spring is coupled to an end cap.

7. The engine and energy storing recoil starter assembly of claim 1, wherein the starter housing includes a cylindrical post having axially extending ribs projecting from the cylindrical post.

8. The engine and energy storing recoil starter assembly of claim 7, wherein the second side of the starter housing includes a retaining structure concentrically located about the cylindrical post such that the at least one buffering component can be provided in an area between the retaining structure and the cylindrical post.

9. The engine and energy storing recoil starter assembly of claim 1, further comprising, a flywheel coupled between the at least one buffering component and the engine.

10. The engine and energy storing recoil starter assembly of claim 9, further comprising first and second flat washers each positioned on one side of the at least one buffering component.

11. The engine and energy storing recoil starter assembly of claim 1, the starter pulley having a boss portion extending from the at least one cam pawl such that the at least one cam pawl projects from an outer peripheral surface of the boss portion.

12. The engine and energy storing recoil starter assembly of claim 1, further comprising, an end cap coupled between the at least one buffering component and the engine.

13. An engine and energy storing recoil starter assembly comprising:

a starter housing including a clutch shell coupled to the starter housing;

a starter pulley operatively coupled with at least one starter dog; and at least one buffering component provided between the engine and starter housing such that the at least one buffering component resiliently connects the engine to the starter housing;

wherein the clutch shell is circumferentially made up of teeth and the at least one starter dog is adapted to engage one of the teeth.

14. The engine and energy storing recoil starter assembly of claim 13, wherein the at least one buffering component includes a torsion spring.

15. The engine and energy storing recoil starter assembly of claim 14, wherein the torsion spring includes a first end and a second end, wherein the first end engages at least one of a flywheel and an end cap.

16. The engine and energy storing recoil starter assembly of claim 15, wherein the second end of the torsion spring engages a first side of the starter housing.

17. An energy storing recoil starter comprising:

a pulley having a recoil spring coupled thereto;

a starter housing;

a clutch shell circumferentially made up of teeth and coupled between the pulley and the starter housing;

at least one starter dog coupled between the pulley and the starter housing, the at least one starter dog being adapted to engage one of the teeth of the clutch shell; and a buffering component coupled between an engine and the starter housing.

18. The energy storing recoil starter of claim 17, wherein the buffering component is a torsion spring.

19. The energy storing recoil starter of claim 17, wherein the buffering component is a flat spring.

20. The energy storing recoil starter of claim 17, the buffering component being a spring having a first end and a second end, the first end of the spring being coupled to the starter housing, the second end of the spring being coupled to an engine shaft of the engine so as to rotate as one.

21. An energy storing recoil starter comprising:

a rotatable engine shaft;

a rotatable housing located on the shaft;

a rotatable buffering component within an operative coupling between the housing and the engine shaft;

a rotatable starter pulley; and a clutch assembly operatively engagable between the housing and the starter pulley to transmit rotational force from the starter pulley to the engine shaft via the housing;

wherein the clutch assembly is configured to be engaged to transmit force from the starter pulley to the engine shaft during engine starting and to be disengaged during engine running.

22. The energy storing recoil starter of claim 21, wherein the clutch assembly separates the starter pulley from the other components during engine running such that the starter pulley does not rotate with the other components during engine running.

23. The energy storing recoil starter of claim 22, wherein the housing and operative coupling, including the buffering component, rotating with the engine shaft during engine running.

24. The energy storing recoil starter of claim 23, wherein the second end of the spring is at least partially enclosed by a flywheel of the engine.

25. The energy storing recoil starter of claim 21, wherein there is no clutch or one-way connection between the housing and the shaft.

26. The energy storing recoil starter of claim 21, wherein there is only one clutch or one-way connection in the sequence of components extending from the pulley to the shaft.

27. The energy storing recoil starter of claim 21, wherein the housing rotates with the shaft while the pulley does not when the engine is running.

28. The energy storing recoil starter of claim 21, wherein the shaft, the housing and the buffering component can rotate as one relative to the starter pulley.

29. The energy storing recoil starter of claim 21, wherein the at least one buffering component includes a spring having a first end and a second end, the first end of the spring being coupled to the starter housing, the second end of the spring being coupled to an engine shaft of the engine so as to rotate as one.

30. The energy storing recoil starter of claim 29, wherein the second end of the spring is at least partially enclosed by a flywheel of the engine.

31. An energy storing recoil starter comprising:

a rotatable engine shaft;

a rotatable housing located on the shaft;

a rotatable starter pulley;

a clutch assembly operatively enactable between the housing and the starter pulley to transmit rotational force from the starter pulley to the engine shaft via the housing; and buffering spring, with one end fixed relative to the shaft and one end fixed relative to the housing, for buffering vibrations from the engine shaft from reaching the starter pulley.

32. The energy storing recoil starter of claim 31, wherein the one end of the buffering spring fixed relative to the shaft cannot rotate relative to the shaft in either rotational direction.

33. An energy storing recoil starter comprising:

a rotatable engine shaft;

a rotatable housing located on the shaft;

a rotatable buffering component within an operative coupling between the housing and the engine shaft;

a rotatable starter pulley; and a clutch assembly operatively enactable between the housing and the starter pulley to transmit rotational force from the starter pulley to the engine shaft via the housing;

wherein the clutch assembly is configured to permit the engine shaft, the housing and the buffering component to rotate as one relative to the starter pulley during engine running.

34. The energy storing recoil starter of claim 33, wherein the starter does not include a one-way coupling between the housing and the engine shaft.

* * * * *